US009789534B2

(12) United States Patent
Noraas et al.

(10) Patent No.: US 9,789,534 B2
(45) Date of Patent: Oct. 17, 2017

(54) INVESTMENT TECHNIQUE FOR SOLID MOLD CASTING OF RETICULATED METAL FOAMS

(71) Applicant: UNITED TECHNOLOGIES CORPORATION, Hartford, CT (US)

(72) Inventors: Ryan B Noraas, Vernon, CT (US); Steven J Bullied, Pomfret Center, CT (US); Mark F Bartholomew, Enfield, CT (US); John F Blondin, South Windsor, CT (US); John Joseph Marcin, Marlborough, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/619,372

(22) Filed: Feb. 11, 2015

(65) Prior Publication Data

US 2016/0207097 A1 Jul. 21, 2016

Related U.S. Application Data

(63) Continuation of application No. 14/600,717, filed on Jan. 20, 2015.

(51) Int. Cl.

| | |
|---|---|
| ***B22C 9/04*** | (2006.01) |
| ***B22C 7/02*** | (2006.01) |
| ***B22D 25/00*** | (2006.01) |
| ***B22D 27/09*** | (2006.01) |
| ***B22D 29/00*** | (2006.01) |

(52) U.S. Cl.

CPC ..... *B22C 9/04* (2013.01); *B22C 7/02* (2013.01); *B22C 7/023* (2013.01); *B22C 9/043* (2013.01); *B22D 25/005* (2013.01); *B22D 27/09* (2013.01); *B22D 29/002* (2013.01); *B22D 29/006* (2013.01)

(58) Field of Classification Search

CPC .. B22C 9/00; B22C 9/04; B22C 9/043; B22C 9/046; B22C 9/08; B22C 9/082; B22D 25/005

See application file for complete search history.

(56) References Cited

U.S. PATENT DOCUMENTS 3,362,463 A 1/1968 Manginelli
3,616,841 A * 11/1971 Walz ..... B22F 3/1121 164/246

(Continued)

FOREIGN PATENT DOCUMENTS

EP 0158082 A2 10/1985
EP 1604756 A2 12/2005

(Continued)

OTHER PUBLICATIONS

English machine translation of EP1604756A2.*
European Search Report for EP 16151323, dated Jun. 8, 2016.
European Search Report for EP 16152118.2, dated Jun. 8, 2016.

*Primary Examiner* — Kevin P Kerns
*Assistant Examiner* — Steven Ha
(74) *Attorney, Agent, or Firm* — Bachman & LaPointe, P.C.

(57) ABSTRACT

A method to manufacture reticulated metal foam includes coating a precursor in a molten wax to increase ligament thickness; and investment coating the molten wax coated precursor with a ceramic plaster.

16 Claims, 8 Drawing Sheets

(56) References Cited

U.S. PATENT DOCUMENTS

| | | | | |
|---|---|---|---|---|
| 3,788,382 | A * | 1/1974 | Daniel | A61C 13/20 164/151.4 |
| 3,933,190 | A | 1/1976 | Fassler et al. | |
| 3,946,039 | A | 3/1976 | Walz | |
| 4,235,277 | A | 11/1980 | Aizawa et al. | |
| 5,720,597 | A | 2/1998 | Wang et al. | |
| 6,187,411 | B1 | 2/2001 | Palmer | |
| 6,412,541 | B2 | 7/2002 | Roesler et al. | |
| 6,443,700 | B1 | 9/2002 | Grylls et al. | |
| 6,652,222 | B1 | 11/2003 | Wojtyczka et al. | |
| 6,711,902 | B2 | 3/2004 | Douglas | |
| 6,827,556 | B2 | 12/2004 | Simon | |
| 6,857,461 | B2 | 2/2005 | Girlich | |
| 6,913,436 | B2 | 7/2005 | McMillan et al. | |
| 6,971,841 | B2 | 12/2005 | Care | |
| 7,045,237 | B2 | 5/2006 | Sridhar et al. | |
| 7,067,208 | B2 | 6/2006 | Gottmann et al. | |
| 7,118,920 | B2 | 10/2006 | Brophy et al. | |
| 7,125,217 | B2 | 10/2006 | Care | |
| 7,135,248 | B2 | 11/2006 | Finn et al. | |
| 7,137,433 | B2 | 11/2006 | Dobesberger et al. | |
| 7,144,651 | B2 | 12/2006 | Finn et al. | |
| 7,175,387 | B2 | 2/2007 | Kreis et al. | |
| 7,255,956 | B2 | 8/2007 | McElroy et al. | |
| 7,448,849 | B1 | 11/2008 | Webster et al. | |
| 7,513,734 | B2 | 4/2009 | McMillan | |
| 7,524,162 | B2 | 4/2009 | Reigl | |
| 7,588,421 | B2 | 9/2009 | Burdgick et al. | |
| 7,594,325 | B2 | 9/2009 | Read | |
| 7,604,199 | B2 | 10/2009 | McMillan et al. | |
| 7,604,781 | B2 | 10/2009 | Brophy et al. | |
| 7,753,654 | B2 | 7/2010 | Read et al. | |
| 7,762,308 | B2 | 7/2010 | Crawford et al. | |
| 7,766,603 | B2 | 8/2010 | Beckford et al. | |
| 7,766,625 | B2 | 8/2010 | Burdgick et al. | |
| 7,775,766 | B2 | 8/2010 | Meier et al. | |
| 7,902,484 | B2 | 3/2011 | Ulrich | |
| 7,905,016 | B2 | 3/2011 | James et al. | |
| 7,922,456 | B2 | 4/2011 | McMillan | |
| 7,942,639 | B2 | 5/2011 | Burdgick et al. | |
| 7,946,827 | B2 | 5/2011 | Beckford | |
| 7,950,147 | B2 | 5/2011 | Meier et al. | |
| 7,968,144 | B2 | 6/2011 | James et al. | |
| 8,047,001 | B2 | 11/2011 | Beeck et al. | |
| 8,052,378 | B2 | 11/2011 | Draper | |
| 8,092,148 | B2 | 1/2012 | Seitz et al. | |
| 8,231,328 | B2 | 7/2012 | Reed | |
| 8,246,291 | B2 | 8/2012 | Wolford | |
| 8,297,912 | B2 | 10/2012 | Reed | |
| 8,304,136 | B2 | 11/2012 | Lee et al. | |
| 8,313,288 | B2 | 11/2012 | Schlichting et al. | |
| 8,327,911 | B2 | 12/2012 | Kush et al. | |
| 8,333,552 | B2 | 12/2012 | Wood et al. | |
| 8,721,290 | B2 | 5/2014 | Darkins, Jr. et al. | |
| 8,763,360 | B2 | 7/2014 | Murdock | |
| 8,777,582 | B2 | 7/2014 | Darkins, Jr. et al. | |
| 8,777,583 | B2 | 7/2014 | Darkins, Jr. et al. | |
| 8,870,547 | B2 | 10/2014 | Grase et al. | |
| 2002/0088958 | A1 | 7/2002 | Weldon | |
| 2017/0001238 | A1 | 1/2017 | Breneman et al. | |

FOREIGN PATENT DOCUMENTS

| | | | |
|---|---|---|---|
| EP | 1604756 | A3 | 12/2005 |
| EP | 1604756 | B1 | 3/2007 |
| ES | 2285604 | T3 | 11/2007 |
| GB | 2010711 | A | 7/1979 |

* cited by examiner

INVESTMENT TECHNIQUE FOR SOLID MOLD CASTING OF RETICULATED METAL FOAMS

CROSS REFERENCE TO RELATED APPLICATION

This application is a continuation and claims the benefit of application Ser. No. 14/600,717, filed Jan. 20, 2015, entitled Dual Investment Technique for Solid Mold Casting of Reticulated Metal Foams.

BACKGROUND

The present disclosure relates to metal foams, more particularly, to a investment method to manufacture metal foam.

Reticulated metal foams are porous, low-density solid foams that includes few, if any, intact bubbles or windows. Reticulated metal foams have a wide range of application and may be utilized in aerospace applications.

Numerous existing manufacturing technologies for producing reticulated metal foams have been attempted, however, automated production of such reticulated structures may be rather difficult to implement as the ceramic investment often proves difficult to remove without damage to the resultant relatively delicate metallic foam structure. Further, the existing manufacturing technologies lack the capability to efficiently manufacturer relatively large sheets of metal foam as the weight of the ceramic investment is sufficient to crush and convolute the shape of the polyurethane foam precursors. This may result in castability complication, polymer burnout, and reduced dimensional tolerances.

SUMMARY

A method to manufacture reticulated metal foam according to one disclosed non-limiting embodiment of the present disclosure includes coating a precursor in a molten wax to increase ligament thickness; and coating the molten wax coated precursor with a ceramic plaster.

A further embodiment of the present disclosure includes, wherein the precursor is a reticulated foam.

A further embodiment of any of the foregoing embodiments of the present disclosure includes coating the precursor in the molten wax via a CNC machine prior to evenly form the wax coating precursor.

A further embodiment of any of the foregoing embodiments of the present disclosure includes coating the precursor in the molten wax to increase ligament thickness to provide an about 90% air to 10% precursor ratio.

A further embodiment of any of the foregoing embodiments of the present disclosure includes, wherein the ceramic plaster is about 28:100 water to powder ratio.

A further embodiment of any of the foregoing embodiments of the present disclosure includes, attaching a wax gating to the coated precursor.

A further embodiment of any of the foregoing embodiments of the present disclosure includes, forming a container to support the wax gating and the coated precursor attached thereto.

A further embodiment of any of the foregoing embodiments of the present disclosure includes, attaching a wax pour cone to one wax gating.

A further embodiment of any of the foregoing embodiments of the present disclosure includes assembling an outer mold assembly to support therein the wax gating and the coated precursor attached thereto.

A further embodiment of any of the foregoing embodiments of the present disclosure includes, assembling the outer mold assembly as a wax-coated tube to contain the wax gating and the coated precursor attached thereto.

A further embodiment of any of the foregoing embodiments of the present disclosure includes, assembling the outer mold assembly with at least one wax rod to form a vent.

A further embodiment of any of the foregoing embodiments of the present disclosure includes, assembling the at least one wax rod to connect at least one wax gating to the wax-coated tube.

A further embodiment of any of the foregoing embodiments of the present disclosure includes, arranging the wax pour cone upside down on a baseplate.

A further embodiment of any of the foregoing embodiments of the present disclosure includes, wherein investment coating the molten wax coated precursor with the ceramic plaster includes pouring the ceramic plaster into the outer mold assembly.

A further embodiment of any of the foregoing embodiments of the present disclosure includes, allowing the ceramic plaster to set up and dry in a humidity-controlled room for minimum of about 2 hours before de-wax for about minimum 3-4 hours at about 250° F. to form a final mold.

A further embodiment of any of the foregoing embodiments of the present disclosure includes, allowing the ceramic plaster to set up and dry to form a final mold.

A further embodiment of any of the foregoing embodiments of the present disclosure includes, pre-heating the final mold for receipt of a molten metal into a pour cone of the final mold.

A further embodiment of any of the foregoing embodiments of the present disclosure includes pressurizing the final mold until the molten metal exits the final mold via a vent.

A further embodiment of any of the foregoing embodiments of the present disclosure includes removing the reticulated metal foam via a citric-based solution that operates to dissolve the ceramic plaster.

A further embodiment of any of the foregoing embodiments of the present disclosure includes removing the reticulated metal foam via a citric-based solution that operates to dissolve the ceramic plaster of the final mold.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
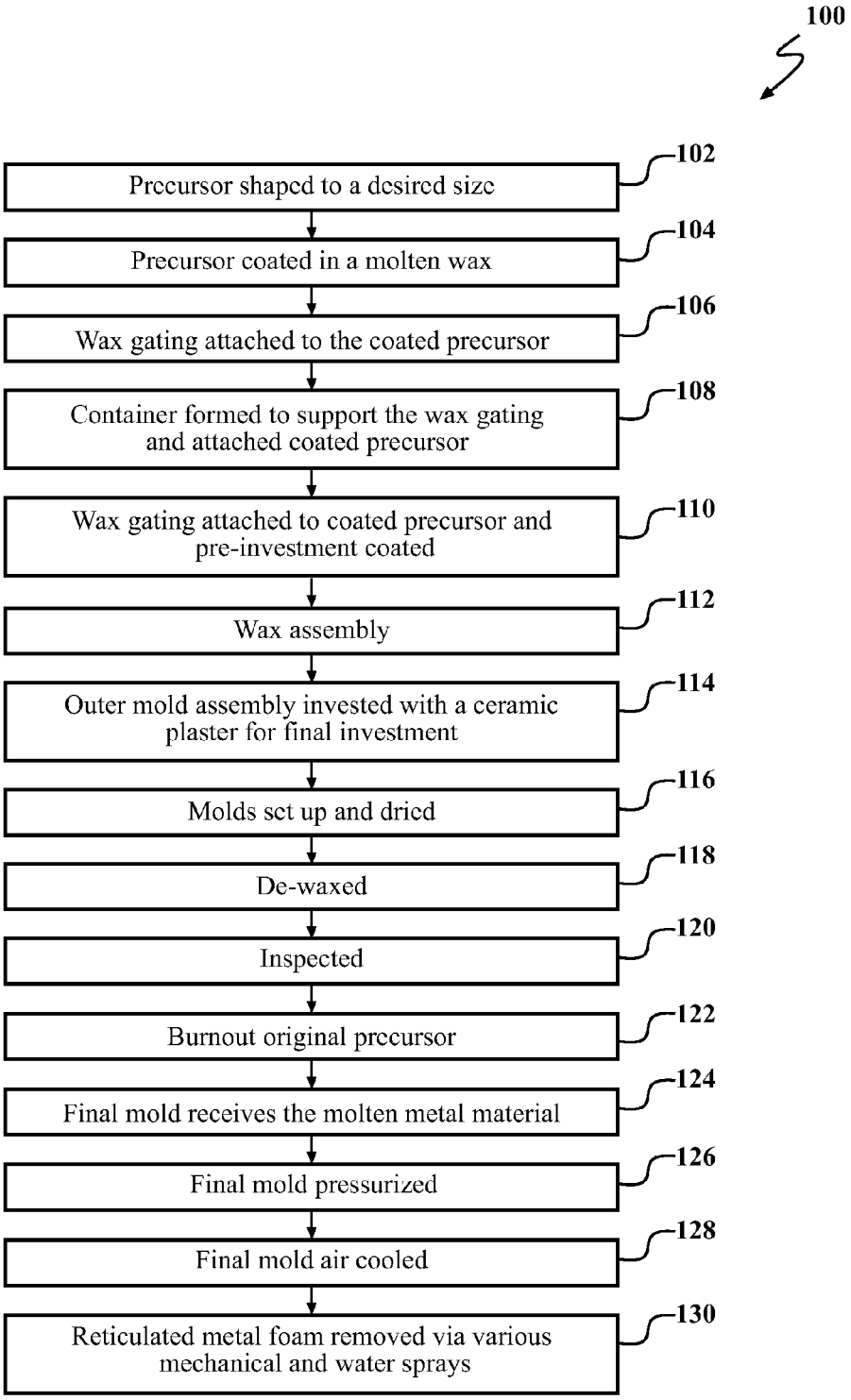
FIG. 1 is a schematic block diagram of a method to manufacture reticulated metal foam via a dual investment solid mold according to one disclosed non-limiting embodiment.

FIG. 1 schematically illustrates a method 100 to manufacture reticulated metal foam via a dual investment solid mold according to one disclosed non-limiting embodiment. The reticulated metal foam is typically manufactured of aluminum, however, other materials will also benefit herefrom.

Initially, a precursor 20 (FIG. 2) such as a polyurethane foam is shaped to a desired size (step 102). In one example, the precursor 20 may be about 2' by 1' by 1.5". The precursor 20 may be a commercially available 14 ppi polyurethane foam such as that manufactured by INOAC USA, INC of Moonachie, N.J. USA, although any material that provides a desired pore configurations usable herewith.

Figure 2:
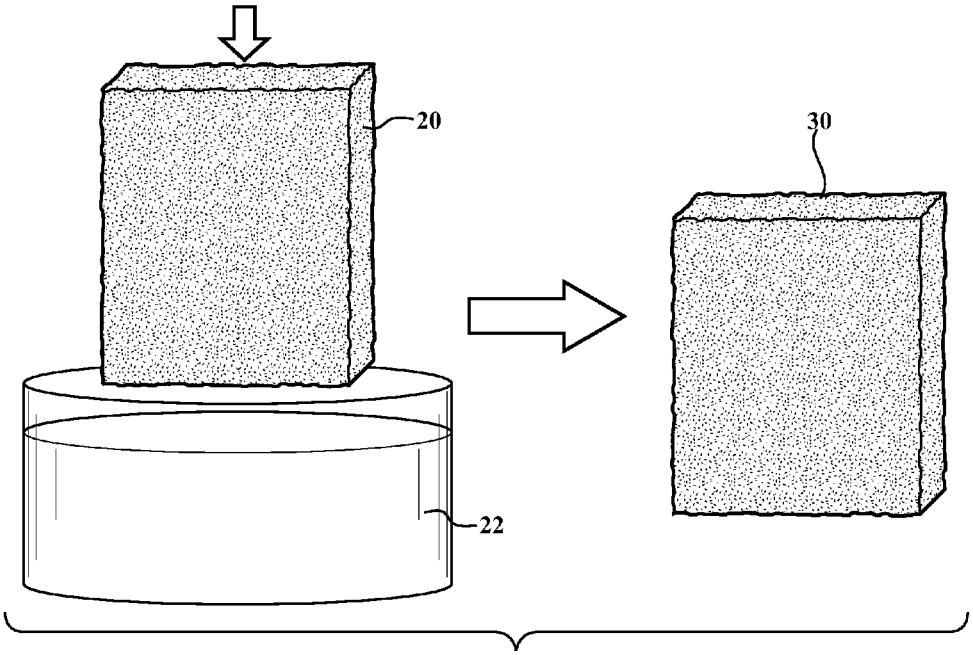
FIG. 2 is a schematic view of one step in the method to manufacture reticulated metal foam.

Next, the precursor 20 is heated, then dipped or otherwise coated in a molten wax 22 to increase ligament thickness (Step 104; FIG. 2). The wax may be melted in electric oven at −215° F. and the precursor 20 may be preheated simultaneously therein as well. In one example, the wax coating increased ligament/strut thickness to provide an about 90% air to 10% precursor ratio to facilitate castability with thicker struts and channels for metal, however, other densities will benefit herefrom as waxing the foam enables casting of the foam due to the passageways formed during de-wax and burnout. The wax coating also facilitates improved/accelerated burnout (passageways for gas).

It should be appreciated that various processes may be utilized to facilitate the wax coating such as location of the precursor 20 into the oven for few minutes to re-melt the wax on the precursor 20; utilization of an air gun used to blow out and/or to even out the wax coating; and/or repeat the re-heat/air gun process as necessary to produce an even coating of wax. Alternatively, or in addition, the precursor 20 may be controlled a CNC machine to assure that the way coating is consistently and equivalently applied. The precursor 20 is then a coated precursor 30 that is then allowed to cool (FIG. 2).

Figure 3:
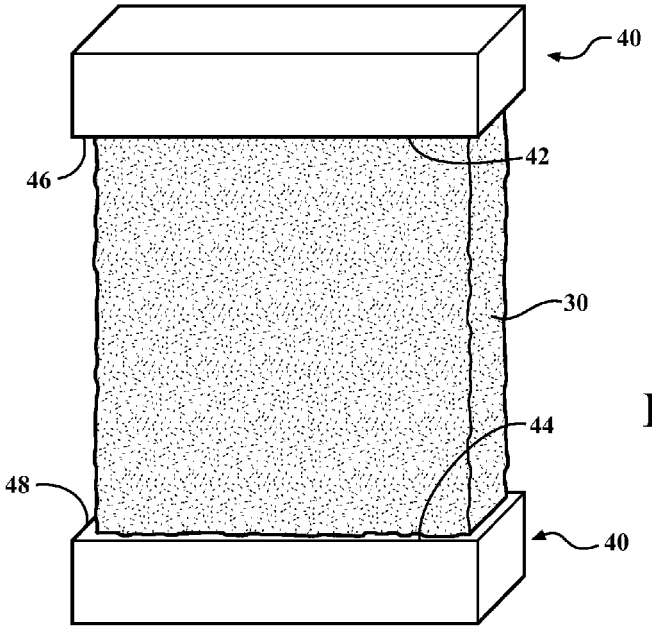
FIG. 3 is a schematic view of one step in the method to manufacture reticulated metal foam.

Next, a wax gating 40 is attached to each end 42, 44 of the coated precursor 30 (step 106; FIG. 3). An edge face 46, 48 of the respective wax gating 40 may be dipped into melted wax as a glue and attached to the coated precursor 30.

Figure 4:
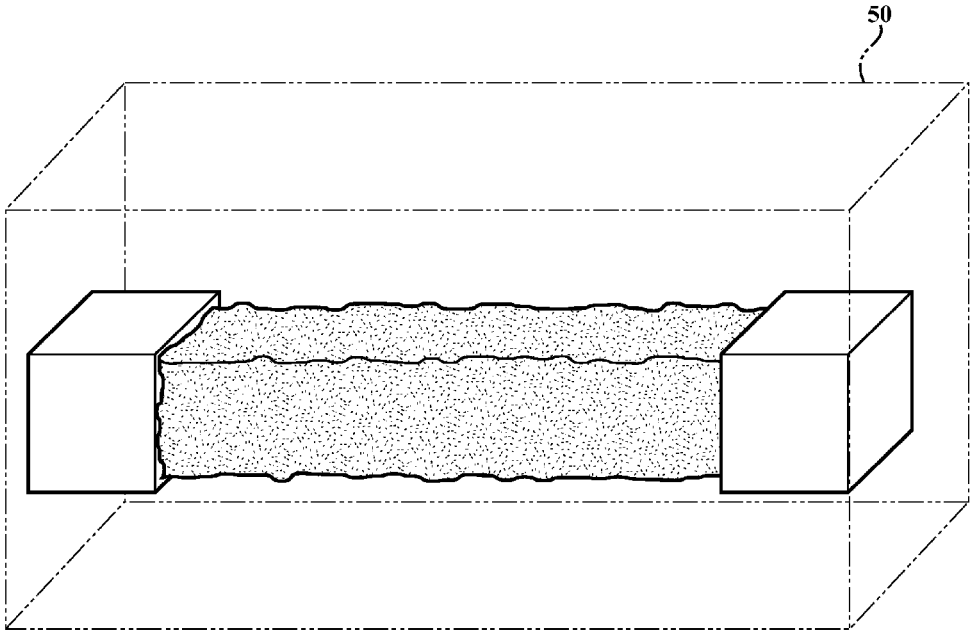
FIG. 4 is a schematic view of one step in the method to manufacture reticulated metal foam.
Figure 5:
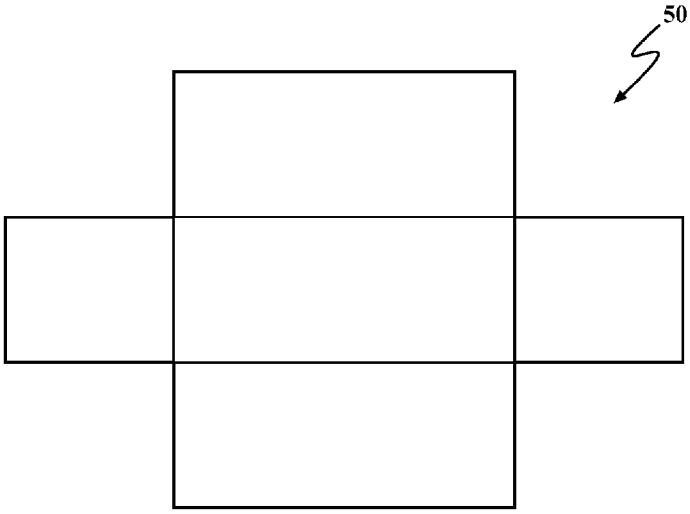
FIG. 5 is a schematic view of one step in the method to manufacture reticulated metal foam.

Next, a container 50 is formed to support the wax gating 40 and attached coated precursor 30 therein (step 108; FIG. 4). The container 50 may be formed as an open-topped rectangular container manufactured from scored sheet wax of about 1/16" thick (FIG. 5). It should be appreciated that other materials such as plastic, cardboard, and others may be utilized to support the wax gating 40 and attached coated precursor 30 therein as well as contain a liquid such that the wax gating 40 can be completely submerged. In one example, the container 50 is about twice the depth of the wax gating 40 and provides spacing completely around the coated precursor 30.

Figure 6:
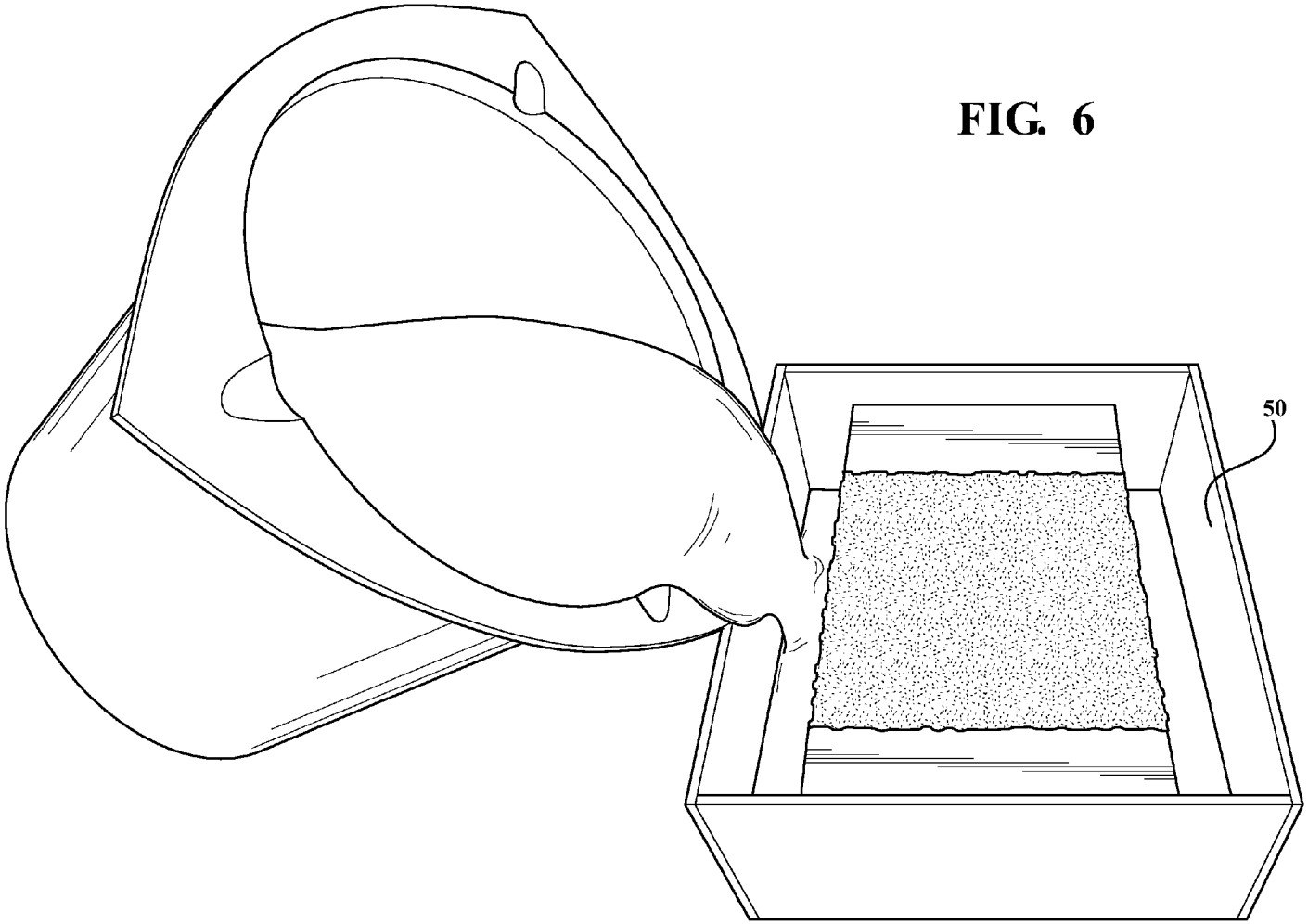
FIG. 6 is a schematic view of one step in the method to manufacture reticulated metal foam.

Next, the wax gating 40 and attached coated precursor 30 is pre-investment coated by pouring a slurry of diluted pre-investment ceramic plaster into the container 50 to form a pre-investment block 60 (step 110; FIG. 6). The pre-investment coating is performed with a ceramic plaster such as an ULTRA-VEST® manufactured by Ransom & Randolph of Maumee, Ohio, USA.

The ceramic plaster may be otherwise mixed per manufacturer's recommendations, but, the ceramic plaster is highly diluted, e.g., water to powder ratio of 55:100 used for ULTRA-VEST® as compared to manufacturer recommended 39-42:100 to provide the diluted pre-investment ceramic plaster. It should be appreciated that various processes may be utilized to facilitate pouring such as a vibration plate to facilitate slurry infiltration into the coated precursor 30; location in a vacuum chamber to remove trapped air, etc. The vacuum may be released once bubbles stop breaching the surface, or slurry starts setting up. The container 50 may then be topped off with excess slurry if necessary.

The heavily water-diluted ceramic plaster reduces the strength of the ceramic, which facilitates post cast removal. The heavily water-diluted ceramic plaster also readily flows into the polymer reticulated foam structure, ensuring 100% investment. This is significant in the production of very dense, fine pore, metal foams.

The pre-investment block 60 is then allowed to harden for about 10 minutes then, once set, transferred to humidity controlled drying room. The final pre-investment block 60, when solidified, is only slightly larger than the original poly foam precursor 20 shape. This step allows maintenance and support of the precursor 20 structural integrity, which would be otherwise compromised. That is, the shape of the precursor 20 is protected. The wax assembly procedure (step 112) can then begin after about 2 hours drying time.

Figure 7:
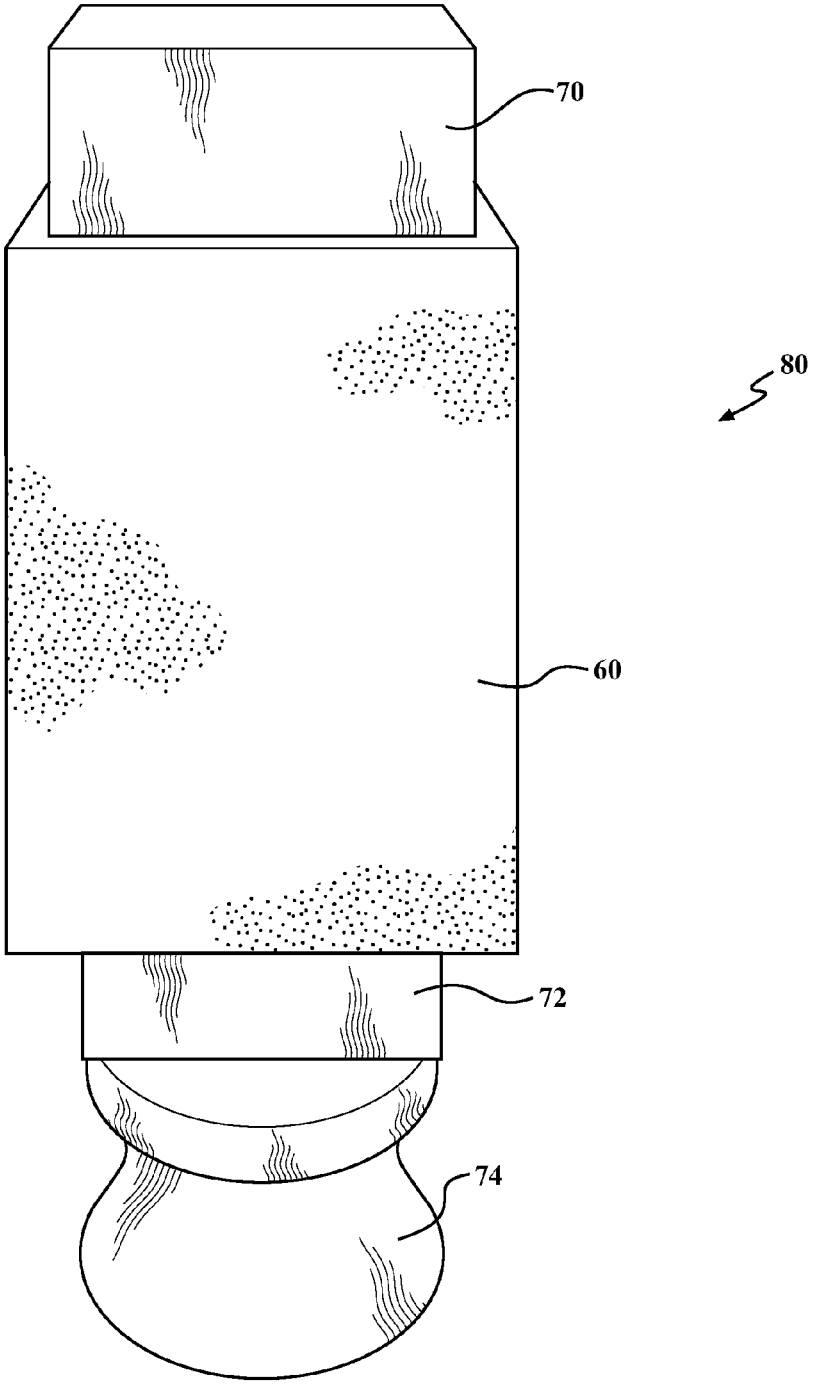
FIG. 7 is a schematic view of a mold assembly the method to manufacture reticulated metal foam.
Figure 8B:
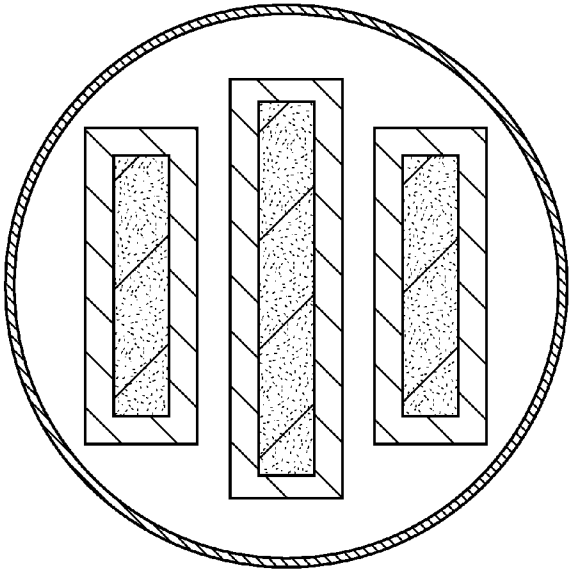
FIG. 8B is a schematic view of an alternative mold assembly for the method to manufacture reticulated metal foam.
Figure 8A:
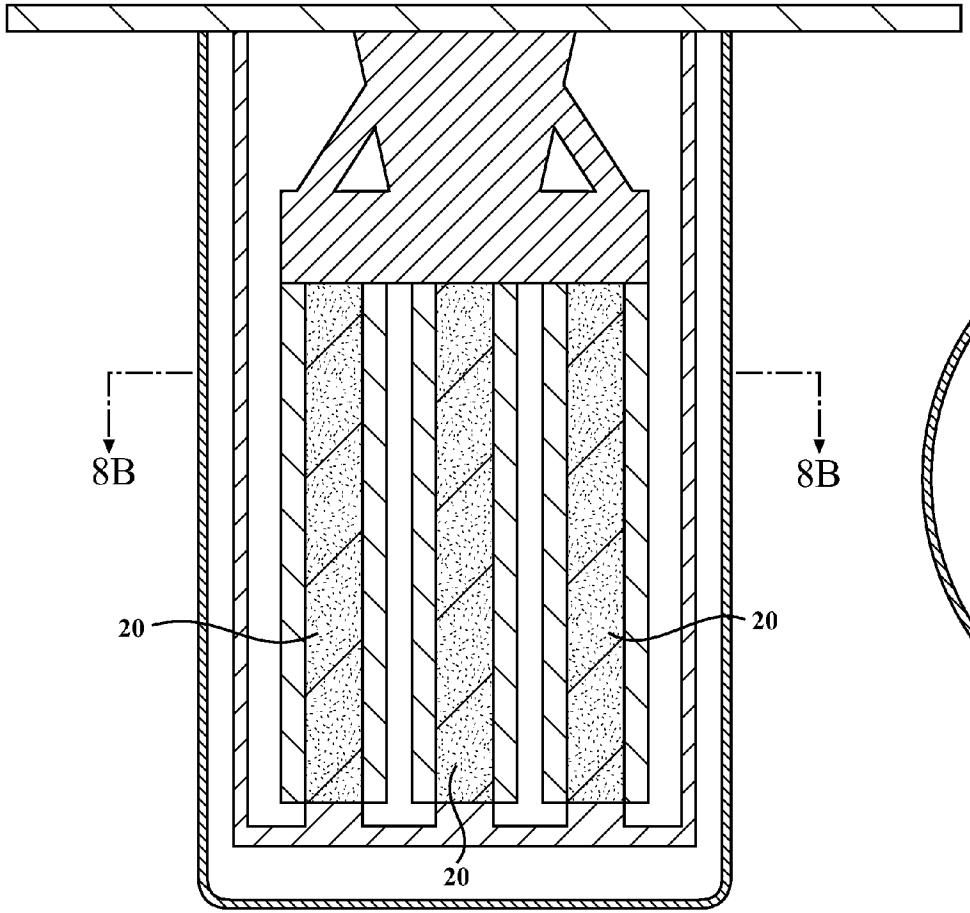
FIG. 8A is a schematic view of an alternative mold assembly for the method to manufacture reticulated metal foam.

The wax assembly procedure (step 112) may include attachment of gates 70, 72 and a pour cone 74 to the pre-investment block 60 to form a gated pre-investment block 80 (FIG. 7). Alternatively, multiple pre-investment blocks 60 may be commonly gated (FIG. 8A, 8B).

Figure 9:
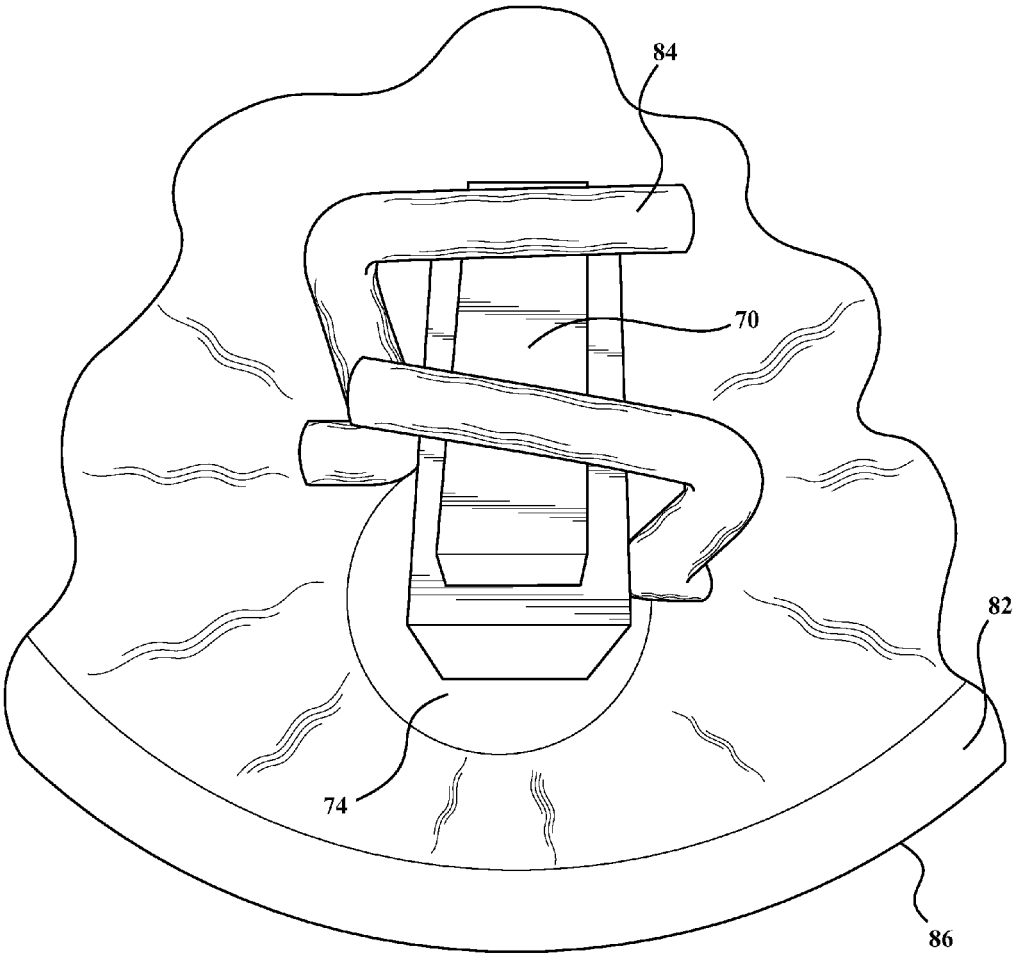
FIG. 9 is a schematic view of one step in the method to manufacture reticulated metal foam.
Figure 10:
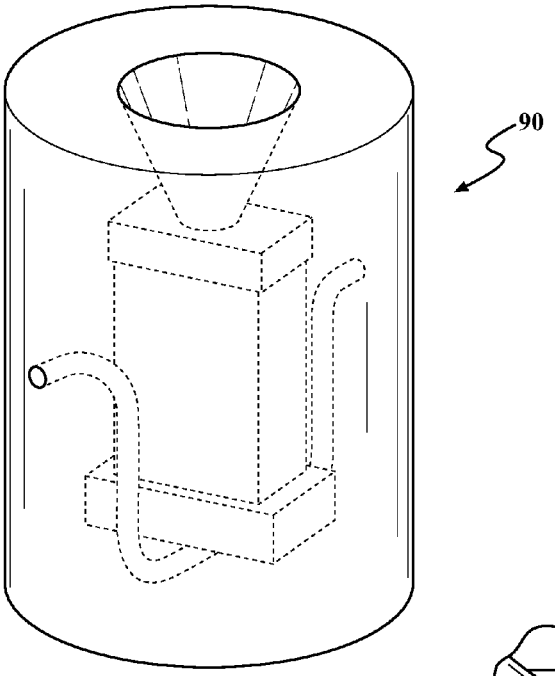
FIG. 10 is a schematic view of one step in the method to manufacture reticulated metal foam.

The gated pre-investment block 80 is then located within an outer mold assembly 82 with wax rods 84 as vents placed inside a wax-coated tube 86 (FIG. 9). That is, the wax rods 84 will eventually form vents in communication with the precursor 20 to receive the molten metal into a funnel formed 87 the pour cone 74. In one example, the pre-invested blocks are arranged pour cone down onto an aluminum baseplate such that liquid wax may be poured into the bottom of wax-coated tube 86 to seal off pour cone 74, prior to final investment.

Next, the outer mold assembly 82 is invested with a ceramic plaster for final investment (step 114). The ceramic plaster may be mixed per manufacturer's recommendations, e.g., water to powder ratio of 28:100 of GLASS-CAST™

910 product. The final investment of the mold 90 is thereby significantly more rigid and robust than the pre-investment ceramic plaster.

The mold 90 is then allowed to set up and dry in a humidity-controlled room for minimum of about 2 hours (step 116) before de-wax (step 118). The final mold 90 may be de-waxed for about minimum 3-4 hours at about 250° F. (preferably overnight).

Once, de-waxed, the mold 90 is inspected (step 120). Various inspection regimes may be provided.

Next, the final mold 90 is placed in a gas burnout furnace to burnout the original precursor 20 (step 122). The burnout may, for example, follow the schedule: 300° F. to 1350° F. in 10.5 hrs (100° F./hour); fast ramp, e.g., ramp rate of 100-200° F./hr max, to 1000 F OK if all water driven out of mold; soak at 1350° F. until burnout complete which may require up to about 12-24 hours depending on mold size.

Figure 11:
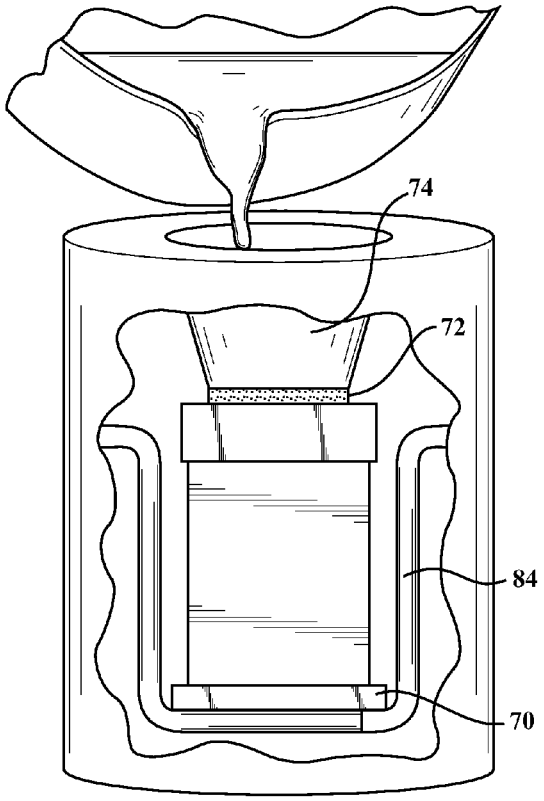
FIG. 11 is a schematic view of one step in the method to manufacture reticulated metal foam.

Next, the mold 90 receives the molten metal material (step 124; FIG. 11). The final mold 90 may be located in a pre-heat oven maintained at about 1350° F. adjacent to a molten metal, e.g., aluminum (A356, A356 and A16101 alloys) maintained at 730° C. with slag skimmed off surface prior to casting. The mold 90 is removed from the pre-heat oven and placed between metal plates designed to sandwich the mold such that molten aluminum is readily poured into the pour cone until flush with top.

The mold 90 may then be pressurized (step 126). The pressure may be between about 5-10 psi or until aluminum exits the mold 90 via the vents formed by the wax rods 84. It should be appreciated that various pressurization and non-pressurization schemes may be alternatively utilized.

The mold 90 is then air cooled at room temperature for about 4-5 hours (step 128). It should be appreciated various time periods may be alternatively required.

The reticulated metal foam may then be removed via various mechanical and/or water sprays (step 130). For example, water may be sprayed to remove the internal investment and mechanical vibration may alternatively or additionally be utilized to facilitate material break up. Repeated rotation between water spray and mechanical facilitates clean metal foam formation. Alternatively, or in addition, a dental plaster remover such as a citric-based solution may be utilized to dissolve the internal investment.

The method 100 to manufacture reticulated metal foam via the dual investment solid mold with diluted pre-investment ceramic plaster is very fluid and fills even dense, fine pore size foams with ease, compared to current technology. The fluidity of the pre-investment reduces likelihood of entrapped bubbles in the foam structure to ensure 100% investment of the foam precursor. Pre-investment of the foam shapes also facilitates relatively larger foam sheets to be cast than existing technologies. This is because the pre-investment surrounds and encapsulates the delicate foam structure and once solidification occurs, preserves the foam structure and shape from distortion during the final solid mold investment step. When trying to cast larger foam sheets without the pre-investment, the weight of the final, heavier, and stronger ceramic investment can move and compress the polyurethane foam.

The pre-investment step also maintains or increases dimensional tolerance as the foam is encapsulated in the light ceramic plaster. The relatively heavier, stronger ceramic, which is poured over the pre-investment, cannot exert pressure, move, or stress the delicate foam structure. The pre-investment step also eliminates the possibility of foam distortion or contamination during the wax assembly mold process. The preinvestment, which was heavily diluted with water over the manufacturer's recommendation, is very weak. After casting, the pre-invested block is removed and can be easily washed away using regular water hose pressure, reducing time and potential for damage to the reticulated metal foam structure.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method to manufacture reticulated metal foam, comprising:

coating a precursor in a molten wax to increase ligament thickness;

coating the molten wax coated precursor with a ceramic plaster; and coating the precursor in the molten wax to increase ligament thickness to provide an about 90% air to 10% precursor ratio.

2. The method as recited in claim 1, wherein the precursor is a reticulated foam.

3. The method as recited in claim 1, wherein the ceramic plaster is about 28:100 water to powder ratio.

4. The method as recited in claim 1, further comprising, attaching a wax gating to the coated precursor.

5. The method as recited in claim 4, further comprising, forming a container to support the wax gating and the coated precursor attached thereto.

6. The method as recited in claim 4, further comprising, attaching a wax pour cone to one wax gating.

7. The method as recited in claim 1, further comprising, assembling the outer mold assembly as a wax-coated tube to contain the wax gating and the coated precursor attached thereto.

8. The method as recited in claim 1, further comprising, assembling the outer mold assembly with at least one wax rod to form a vent.

9. The method as recited in claim 8, further comprising, assembling the at least one wax rod to connect at least one wax gating to the wax-coated tube.

10. The method as recited in claim 9, further comprising, arranging the wax pour cone upside down on a baseplate.

11. The method as recited in claim 10, wherein investment coating the molten wax coated precursor with the ceramic plaster includes pouring the ceramic plaster into the outer mold assembly.

12. The method as recited in claim 11, further comprising, allowing the ceramic plaster to set up and dry in a humidity-controlled room for minimum of about 2 hours before de-wax for about minimum 3-4 hours at about 250° F. to form a final mold.

13. A method to manufacture reticulated metal foam, comprising:

coating a precursor in a molten wax to increase ligament thickness;

coating the molten wax coated precursor with a ceramic plaster; and coating the precursor in the molten wax via a CNC machine to evenly form the wax coating precursor.

14. A method to manufacture reticulated metal foam, comprising:

coating a precursor in a molten wax to increase ligament thickness;

coating the molten wax coated precursor with a ceramic plaster;

attaching a wax gating to the coated precursor;

forming a container to support the wax gating and the coated precursor attached thereto; and assembling an outer mold assembly to support therein the wax gating and the coated precursor attached thereto.

15. A method to manufacture reticulated metal foam, comprising:

coating a precursor in a molten wax to increase ligament thickness;

coating the molten wax coated precursor with a ceramic plaster;

allowing the ceramic plaster to set up and dry to form a final mold;

pre-heating the final mold for receipt of a molten metal into a pour cone of the final mold;

pressurizing the final mold until the molten metal exits the final mold via a vent; and removing the reticulated metal foam via a citric-based solution that operates to dissolve the ceramic plaster.

16. A method to manufacture reticulated metal foam, comprising:

coating a precursor in a molten wax to increase ligament thickness;

coating the molten wax coated precursor with a ceramic plaster;

allowing the ceramic plaster to set up and dry to form a final mold; and removing the reticulated metal foam via a citric-based solution that operates to dissolve the ceramic plaster of the final mold.

* * * * *